US012552628B2

(12) United States Patent
Schilling

(10) Patent No.: US 12,552,628 B2
(45) Date of Patent: Feb. 17, 2026

(54) APPARATUS FOR CUTTING A MATERIAL WEB INTO INDIVIDUAL SHEETS WITH A WEB STORAGE

(71) Applicant: BW Papersystems Stuttgart GmbH, Nürtingen (DE)

(72) Inventor: Andreas Schilling, Lichtenstein (DE)

(73) Assignee: BW Papersystems Stuttgart GmbH, Nürtingen (DE)

( * ) Notice: Subject to any disclaimer, the term of this patent is extended or adjusted under 35 U.S.C. 154(b) by 824 days.

(21) Appl. No.: 17/045,685

(22) PCT Filed: Feb. 11, 2020

(86) PCT No.: PCT/EP2020/053412
§ 371 (c)(1),
(2) Date: Oct. 6, 2020

(87) PCT Pub. No.: WO2020/169401
PCT Pub. Date: Aug. 27, 2020

(65) Prior Publication Data

US 2021/0024314 A1 Jan. 28, 2021

(30) Foreign Application Priority Data

Feb. 20, 2019 (DE) ..... 1020191042755
Jul. 24, 2019 (DE) ..... 1020191199948

(51) Int. Cl.
*B65H 20/34* (2006.01)
*B65H 23/16* (2006.01)
*B65H 35/08* (2006.01)

(52) U.S. Cl.
CPC ..... *B65H 20/34* (2013.01); *B65H 23/16* (2013.01); *B65H 35/08* (2013.01);
(Continued)

(58) Field of Classification Search
CPC ..... B65H 20/34; B65H 23/16; B65H 35/08; B65H 2301/515323; B65H 2408/2171;
(Continued)

(56) References Cited

U.S. PATENT DOCUMENTS 3,730,515 A * 5/1973 Spiess ..... B65H 5/26 271/225
4,136,865 A * 1/1979 Marass ..... B65H 29/6636 271/182

(Continued)

FOREIGN PATENT DOCUMENTS

DE 2906567 A1 8/1980
DE 10308829 A1 * 9/2004 ..... B26D 11/00

(Continued)

OTHER PUBLICATIONS

International Search Report in corresponding International Application No. PCT/EP2020/053412, mailed Jun. 30, 2020.

*Primary Examiner* — Jonathan G Riley
(74) *Attorney, Agent, or Firm* — Andrus Intellectual Property Law, LLP

(57) ABSTRACT

An apparatus, in particular roll-type cross cutter, is shown and described, further in particular for forming a shingled stream of underlapping or overlapping sheets, in particular sheets of paper or cardboard, having a cross-cutting device for cutting a material web into individual sheets and having a web storage upstream of the cross-cutting device along the web transport path for storing and/or providing a material web, the material web being fed to the web storage from a web unwinding. According to the invention, it is provided that the web storage for storing the material web is arranged in the region of the cross-cutting device below the running height of the sheets.

11 Claims, 3 Drawing Sheets

(52) U.S. Cl.
CPC ..... *B65H 2301/515323* (2013.01); *B65H 2408/2171* (2013.01); *B65H 2701/176* (2013.01)

(58) Field of Classification Search
CPC .... B65H 2701/176; B65H 23/26; B21C 49/00
See application file for complete search history.

(56) References Cited

U.S. PATENT DOCUMENTS 4,886,199 A * 12/1989 Noe ..... B21C 49/00 226/118.2
5,133,106 A * 7/1992 Milbredt ..... B60B 33/021 188/69
5,275,394 A * 1/1994 Mank ..... B65H 29/6636 271/216
5,320,266 A * 6/1994 Noe ..... B65H 20/34 318/7
5,727,748 A * 3/1998 Prittie ..... B65H 18/145 242/538.2
5,800,325 A * 9/1998 Wilkes ..... B31B 70/006 493/22
5,810,236 A * 9/1998 Yoshida ..... B65H 20/34 226/118.3
5,950,510 A 9/1999 Scheffer
6,024,683 A * 2/2000 Wilkes ..... B65H 20/34 493/210
6,588,641 B2 * 7/2003 Prittie ..... B65H 20/24 226/118.3
7,802,504 B1 * 9/2010 Wilkes ..... B26D 5/42 83/257
7,942,406 B2 * 5/2011 Ootaki ..... B65H 29/6636 271/197
2004/0028448 A1 2/2004 Seiler
2007/0125820 A1 * 6/2007 Weber ..... B65H 20/34 226/118.3
2010/0044946 A1 2/2010 Ootaki
2012/0145762 A1 * 6/2012 Maruhata ..... B65H 19/14 226/189
2013/0112728 A1 * 5/2013 Clement ..... B65H 26/02 226/1
2018/0079615 A1 * 3/2018 Shigehara ..... B65H 23/1888

FOREIGN PATENT DOCUMENTS

DE 202018103354 U1 9/2018
EP 0761582 A2 * 3/1997
EP 1944259 A2 7/2008
JP 2007210750 A 8/2007
JP 2010254430 A 11/2010
WO 2017175112 A1 10/2017
WO WO 2018/229201 A1 12/2018

* cited by examiner

APPARATUS FOR CUTTING A MATERIAL WEB INTO INDIVIDUAL SHEETS WITH A WEB STORAGE

CROSS-REFERENCE TO RELATED APPLICATIONS

This application is the U.S. national stage application of International Application PCT/EP2020/053412, filed Feb. 11, 2020, which International Application was published on Aug. 27, 2020, as International Publication WO 2020/169401 in the German language. The International Application claims priority to German Application No. 10 2019 104 275.5, filed Feb. 20, 2019, and German Application No. 10 2019 119 994.8, filed Jul. 24, 2019. The International Application and German Applications are all incorporated herein by reference, in their entireties.

FIELD

The invention relates to an apparatus, in particular roll-type cross cutter, further in particular for forming a shingled stream of underlapping or overlapping sheets, in particular paper or cardboard sheets, having a cross-cutting device for cutting a material web into individual sheets and having a web storage upstream of the cross-cutting device along the web transport path for storing and/or providing a material web, wherein the material web is fed to the web storage from a web unwinding.

BACKGROUND

A corresponding apparatus is known, for example, from WO 2018/229201 A1. With the known apparatus, sheets of paper or cardboard can be provided as quasi endless material webs in the form of a paper roll from the web unwinder. After the unwinding of the web, the material web is fed to a cross cutting device by means of a feeding device with rollers or rolls and cut there into sheets of defined length. The cut sheets are fed by means of conveyor belts to a shingling device to form an underlap of the sheets. The shingled stream thus formed can then be fed to a further processing machine, for example a printing machine.

The printing machine acts as a clock generator for the entire system and determines the point in time at which a sheet must be prepared with its leading edge at a transfer point of the printing machine. The shingling device and the cross-cutting device must therefore run synchronously with the printing press in order to ensure that the sheets are prepared in time in the cycle of the printing machine. In case of a system stop, for example to change the paper roll, the printing machine, the shingling device and the cross-cutting device must be slowed down or stopped synchronously. Due to the inertia of the paper roll, however, the web unwinding cannot be slowed down as quickly as the shingling device and the cross-cutting device. Due to the slower braking of the web unwinding, the web unwinding provides further material web until it stops. The excess web must be picked up by the device in a controlled manner to avoid damage to the web and/or winding errors when the printing press is restarted. Therefore, a web storage is provided along the web transport path between the web unwind and the feeding device in order to be able to safely pick up or store a certain length of the web of paper.

The web storage revealed in WO 2018/229201 A1 has vertically running web loops. A web loop is formed between two horizontally arranged, fixed deflection rollers and a deflection roller which can be moved in vertical direction relative to the fixed deflection rollers. The material web wraps around the fixed deflection rollers at least in sections and wraps around the movable deflection roller essentially by 180°. The length of the web loop corresponds to the distance between the movable deflection roller and the plane formed by the axes of rotation of the fixed deflection rollers.

During operation of the roll cross-cutter, the movable deflection roller is in a home position in which no web material or only a short length of the material web is stored. When braking the roll cross-cutter, the movable deflection roller is moved vertically in such a way that the length of the web loop is increased. The supply of outgoing material web taken up by the movable deflection roller is dimensioned in such a way that the excess part of the material web provided by the web unwind is taken up by the web storage. The movable deflection roller can be brought into a maximum storage position which defines a maximum distance of the movable deflection roller perpendicular to the plane formed by the axes of rotation of the fixed deflection rollers. The vertical distance between the basic position and the maximum storage position is also called the maximum storage distance of the movable deflection pulley. The storage distance thus determines the length of a formed web loop, depending on the position of the basic position. The length of the web loop can essentially correspond to twice the storage distance. When starting up the sheeter, the drive of the web unwind can be started with a time delay or slower, so that the paper storage can release the excess web.

The web storage shown in WO 2018/229201 A1 has two movable and three fixed deflection rollers. Accordingly, two identical web loops are formed in the web storage and the length of the stored material web corresponds to four times the length of the storage section.

The use of a web storage thus allows to stop and/or start a material web processing unit connected in series with a time delay. In this way a gentle braking and/or acceleration of individual devices and/or equipment can be realized. A web storage can also be used to temporarily compensate for different speeds of successive processing devices and/or assemblies of the material web processing. For the reasons mentioned above, web storages can be used in a variety of ways, for example to enable continuous operation during a splicing process of the material web.

A disadvantage of the above-mentioned web storage is the additional and large-area space requirement. A sufficiently large space must be provided for the web storage between the web unwinding and the cross-cutting device. In order to be able to store a sufficient length of the material web, web storages are built very high, which considerably impairs the machine operator's view of the line and especially the machine operator's view of the web unwinding. Furthermore, maintenance work is very costly due to the height of the web storage, as the upper part of the web storage can only be accessed by means of ladders and/or lifting devices.

Against this background, it is the task of the present invention to provide a cross-cutting apparatus of the type mentioned above, which is characterized by a compact and space-saving design. Furthermore, the accessibility to all devices of the apparatus, especially to the web storage, for example for maintenance and repair work, shall be improved. At the same time, the clarity for the machine operator is to be increased.

SUMMARY

The above-mentioned tasks are solved by a device with the features of claim 1. Advantageous designs are the subject of the subclaims.

In the apparatus according to the invention, the web storage for storing the material web is not arranged laterally between the cross cutting device and the web unwinding in order to solve the above mentioned tasks, but in the area of the cross cutting device below the running height of the sheets. For the purpose of the present invention, the term "running height of the sheets" refers to the height of the transport plane of the material web cut into sheets in the apparatus according to the invention after passing the cross cutting device. The arrangement of the web storage below the cross cutting device and below the functional units following in the direction of sheet transport (shingling; transport and braking) allows a reduction of the overall length of the apparatus with improved accessibility of a machine operator to the functional units of the apparatus, for example for maintenance and repair work, and an improved overview of the machine operator.

The system boundary of the term "web storage" in the sense of the invention preferably comprises only the fixed deflection rollers provided for the formation of web loops and the at least one movable deflection roller cooperating with these, as well as possibly further functional units, such as a drive and/or a control for the movable deflection roller. The system boundary of the functional unit "web storage" can thereby include an area of the transport path of the material web which begins before a first fixed deflection roller provided for forming a web loop and ends after a last fixed deflection roller provided for forming a web loop. In particular, however, the system boundary does not include further deflection rollers which are provided for feeding or continuing the material web from the web unwinding to the first fixed deflection roller and/or for discharging the material web from the last fixed deflection roller in the direction of a material web draw-in before the cross-cutting device.

The web storage forms at least one web loop, preferably two web loops, for storing the material web. The web loop can be changed lengthwise by changing the position of a movable deflection roller relative to a fixed deflection roller.

To form a web loop, the material web unwound from the web unwinding is preferably guided via a fixed deflection roller to a movable deflection roller and further to another fixed deflection roller. The fixed deflection rollers can be arranged next to each other at a distance that essentially corresponds to the diameter of the movable deflection roller. The material web wraps around the fixed deflection rollers at least in sections and wraps around the movable deflection roller preferably substantially by 180. The movable deflection roller can be moved perpendicular to the plane formed by the axes of rotation of the fixed deflection rollers. The total length of a web loop preferably corresponds essentially to the distance between a first fixed deflection roller to an immediately following movable deflection roller and the distance between the movable deflection roller to an immediately following second fixed deflection roller.

However, it is also possible for the web storage to have several movable deflection rollers and several stationary deflection rollers.

In an advantageous embodiment of the invention, the web storage is designed for storing the material web substantially horizontally. The term "horizontal storage" in the present case means that the at least one web loop for storing the material web runs essentially in a horizontal direction. In particular, the invention also includes a slight inclination of the formed web loop to the horizontal, which can be advantageous in order to optimally utilize the installation space below the running height of the sheets. The movable deflection roller is then moved essentially in a horizontal direction in order to change the length of a web loop of the web storage. Compared to a vertical design of the web loop, the height of the web storage and thus the height of the entire device can be significantly reduced. At the same time this arrangement of the web storage allows a compact design and a reduced space requirement of the device. In addition, the lower overall height of the device improves the operator's overview, especially the view of the web unwinding. Easy access to all components or functional units of the web storage, especially for repair and/or maintenance work, can thus be easily ensured.

Preferably, the fixed deflection rollers of the web storage are arranged vertically one above the other. The material web can be fed vertically into the web storage or the first and the last fixed deflection roller and the deflection roller involved in the formation of the web loop can be vertically fed in or out.

A shingling device downstream of the cross-cutting device in the transport direction of the sheets is advantageously provided for overlapping or underlapping the sheets in certain areas. Preferably, the web storage is located below the functional units "cross cutting" and "shingling" and, if necessary, further downstream functional units. The web storage is then stored below the running height of the sheets or below the transport path of the sheets in relation to the area between the cross-cutting device and the shingling device. The maximum length of a storage section of the web storage, i.e. the maximum distance between a basic position of a movable deflection roller and its maximum storage position, in which the length of the web loop becomes maximum, can essentially correspond to the distance between the cross cutting device and the shingling device.

A braking device downstream of the shingling device in the transport direction of the sheets is also provided to brake shingled sheets, in particular by forming a braking gap for the passage of sheets brought together in an overlapping manner. The web storage is preferably arranged below the functional units "cross cutting", "shingling" and "braking" as well as, if necessary, further downstream functional units. The material web is then stored below the running height of the sheets or below the transport path of the sheets in relation to the area between the cross-cutting device and the braking device or even beyond. The maximum length of a storage section of the web storage, i.e. the maximum distance between a basic position of a movable deflection roller and its maximum storage position, in which the length of the web loop becomes maximum, can essentially correspond to the distance between the cross-cutting device and the braking device. In principle, it is possible, by suitable arrangement of the deflection rollers of the web storage, to extend the web loops below the running height of the sheets, if necessary, into an area downstream of the braking device in the transport direction of the sheets.

In a further advantageous embodiment of the invention, a material web infeed upstream of the cross cutting device in the transport direction of the material web is provided for the driven feeding of the material web from the web storage to the cross cutting device. The web storage can then also be arranged below the feed height of the material web to the material web infeed.

The maximum storage distance of the web storage, i.e. the maximum distance between a basic position of a movable deflection roller and its maximum storage position, in which the length of the web loop becomes maximum, can thus be extended beyond the position of the cross cutting device into the area of the material web infeed or even beyond that in the direction of the web unwinding. The maximum length of a storage section can essentially correspond to the distance between the webbing-up device and the braking device.

In an advantageous design, the web storage has at least two stationary deflection rollers, wherein, preferably, the stationary deflection rollers are arranged between the cross-cutting device and the web unwinding device, preferably in the region between the material web infeed and the web unwinding below the running height of the sheets. The area between the material web infeed and the web unwind is the space which is bounded in the horizontal direction by a first vertical plane through the material web infeed and a second vertical plane through the web unwind. The first vertical plane through the webbing-up device is defined by the axis of the driving roller of the webbing-up device. The second vertical plane is defined by the rotation axis of the web unwind. With reference to a side view of the device, the fixed deflection rollers can be arranged between the cross-cutting device and the web unwinding, preferably between the material web infeed and the web unwind. The fixed deflection rollers are vertically spaced from each other and preferably arranged vertically one above the other. In this way, the available space for the web storage can be optimally used.

Further preferably the web storage has at least one, preferably at least two, further preferably together, horizontally moveable deflection rollers, whereby the moveable deflection roller can be adjusted into a threading position in the direction of the web unwinding, which is laterally of the fixed deflection rollers in the area between the fixed deflection rollers and the web unwinding. When the movable deflection roller has reached the threading position, it is possible to feed the material web-without the formation of web loops-directly between the fixed deflection rollers and the at least one movable deflection roller in the manner of a bypass, preferably vertically upwards to the material web infeed. Further preferably, the material web can be fed substantially linearly, i.e. without substantial deflection, between the fixed deflection rollers and the at least one movable deflection roller. Web storage is preferably not provided if the movable deflection roller is in the threading position. Web storage is only possible when the movable deflection roller is moved relative to the fixed deflection rollers in the direction away from the threading position.

A drive for moving the movable deflection roller in the web storage is preferably provided. A common drive is also preferably provided for several movable deflection rollers. The movable deflection rollers are then preferably moved together, i.e. simultaneously. However, it is also possible to provide a separate drive for each movable deflection roller. The movable deflection rollers can alternatively or additionally also be designed to be manually adjustable or displaceable.

In an advantageous embodiment of the invention, the movable deflection roller is horizontally movable within the web storage from the basic position to the maximum storage position over a distance of at least 500 mm to a maximum of 5,000 mm, preferably from at least 1,000 mm to a maximum of 3,500 mm, preferably from 2,000 mm.

In the event of a system stop, the movable deflection roller can be moved as a function of the roller diameter of the web unwind and/or the conveying speed of the material web.

The maximum storage position of a movable deflection roller, preferably of all movable deflection rollers, is preferably reached in the horizontal direction in the area between the cross-cutting device and the braking device, further preferably in the area between the shingling device and the braking device. A maximum storage position is achieved particularly preferably when the movable deflection roller is vertically below the braking device.

In an advantageous embodiment of the invention, the web storage has at least one horizontally movable dancer deflection roller for influencing the material tension, wherein, preferably, the dancer deflection roller is provided along the web transport path in the region between two movable deflection rollers of the web storage. When unwinding and processing a material web, it is important to maintain as constant a web tension as possible in order to prevent damage to the material web and to ensure fault-free processing of the material web. The dancer deflection roller can compensate for fluctuations in the web tension. For this purpose, the dancer deflection roller forms a web loop in the material web. The compensation of web tensions is achieved by the dancer guide roller performing small stroke movements, which slightly increase or decrease the length of the web transport path. If the web tension is too low, the dancer roller is moved in such a way that the web transport path is extended. Conversely, if the web tension is increased, the length of the web transport path is reduced by an opposite stroke movement of the dancer guide roller. In this way, the control of the web tension can be integrated into the web storage. This eliminates the need to provide a separate device for controlling the web tension. By integrating the web tension control into the web storage, a more compact design of the device can be achieved, which further reduces the space requirement of the device.

The compensating movements of the dancer deflection roller can be actively controlled. The dancer pulley itself can serve as measuring element. Alternatively, a separate web tension measuring roller can be used to measure the web tension, which is then only used to measure the web tension. The dancer guide roller is preferably moved by means of a hydraulic cylinder. Alternatively, it is also possible to let the dancer guide roller act on the web in an uncontrolled manner, for example by means of a spring force.

Preferably, the web storage has a first fixed deflection roller along the web transport path. The material web can then be guided around a first movable deflection roller, forming a first web loop. The following deflection roller along the web transport path is then preferably designed as a dancer deflection roller. The material web can then be guided around a second movable deflection roller to form a second web loop before the material web is guided over a second fixed deflection roller and can leave the web storage. Thus, two web loops can be formed in the web storage and the maximum length of the stored material web corresponds to four times the length of the maximum storage section.

Preferably, the dancer deflection roller is designed to be movable over a distance of at least 50 mm to a maximum of 500 mm, preferably from at least 10 mm to a maximum of 350 mm, preferably from 250 mm. The lengths of the above-mentioned travels have proved to be particularly suitable for controlling the material web tension.

In a preferred embodiment of the invention, the web storage, and, preferably, together with the cross-cutting device and the shingling device, is mounted on a chassis which is designed to be movable laterally, preferably perpendicularly, to the transport direction of the sheets relative to the web unwinding. On the common travelling stand can also be additionally arranged the material web infeed and/or the braking device and/or a transport device for the material web and/or sheets with at least one transport roller and/or a transport belt and, if necessary, further components and subassemblies. The chassis may be mounted on rollers and/or rails. By means of the chassis which can be moved laterally to the web unwinding, good accessibility is ensured during maintenance and/or repair work of the devices mounted on the chassis. At the same time, better accessibility to the adjacent components and assemblies of the undercarriage is also achieved. It is also conceivable that a chassis together with the web storage stored on the chassis and further components and subassemblies can be exchanged for another chassis with another web storage and, if necessary, further other components and subassemblies.

The previously described embodiments of the invention can be combined with each other as required. The disclosure content of the invention is not limited to the combinations of inventive features given by the selected paragraph formatting.

Further features of the present invention result from the following description of an execution example of the invention using the drawings and the drawings themselves. All described and/or pictorially depicted features, on their own or in any combination, form the subject matter of the present invention, irrespective of their combination in the claims or their retro-relationships.

BRIEF DESCRIPTION OF THE DRAWINGS

The invention is explained in more detail below on the basis of the figures; it shows FIG. 1 a schematic representation of an apparatus according to the invention for cutting a material web into individual sheets with a web storage in a side view, FIG. 2 a schematic representation of the web storage shown in FIG. 1, which is arranged on a chassis, wherein movable deflection rollers of the web storage are in a home position and FIG. 3 a schematic representation of the web storage arranged on the chassis in FIG. 1, whereby the movable deflection rollers are in a maximum storage position.

DETAILED DESCRIPTION

Figure 1:
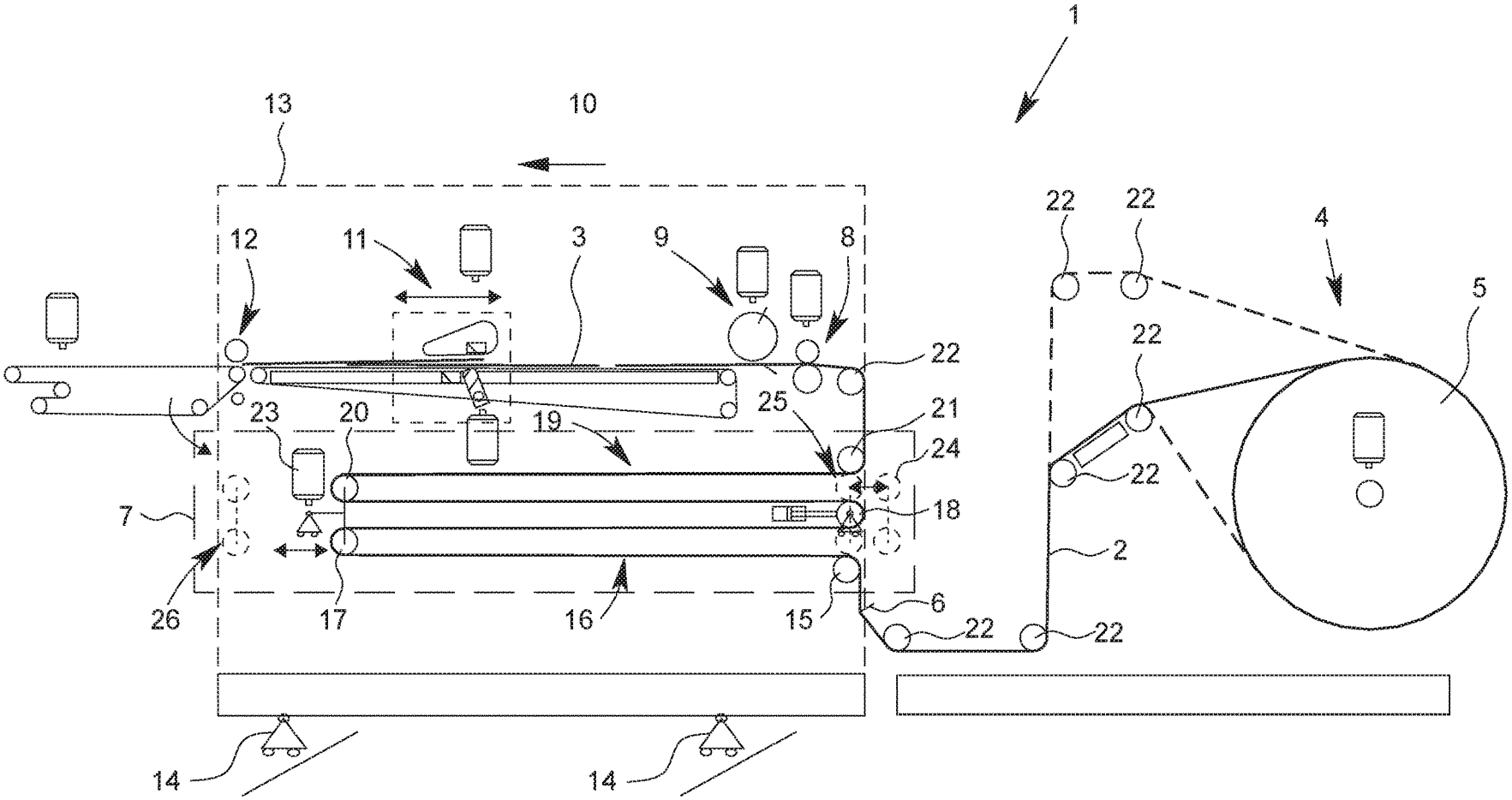

FIG. 1 schematically shows an apparatus 1 according to the invention for cutting a material web 2 into individual sheets 3 of paper or cardboard. The device 1 has a web unwinding 4 which provides a quasi endless material web 2 from a paper roll 5. The material web 2 is provided by the web unwinding 4 and can initially be conveyed over several deflection rollers 22. FIG. 1 shows that by adjusting the height of deflection rollers 22, different web transport routes from the web unwinder 4 with different lengths to the following functional units can be realized.

After passing two fixed deflection rollers 22, the material web 2 can be pulled over a crushing tool 6 to compensate for curvatures that may have been caused by the rolled up bearing of the material web 2 on a paper roll 5.

Along the transport path of the material web 2, a web storage 7 is provided after the web unwind 4, through which the material web 2 passes. A preferred system limit of the functional unit "web storage" is shown schematically as a dashed line in FIG. 1.

The web storage 7 is followed along the web transport path by a material web infeed 8 which serves to drive the material web 2. The material web 2 is then led to a cross cutting device 9, where the material web 2 is cut into sheets 3. In transport direction 10 of the sheets 3, a shingling device 11 is arranged downstream of the cross cutting device 9, with which an overlapping shingled stream is produced. A braking device 12 is provided downstream of the shingling device 11 in the transport direction 10 of the sheets 3, wherein the braking device 12 can be formed, for example, by nip rollers. This is already described in WO 2018/229201 A1. The disclosure content of WO 2018/229201 A1 is hereby incorporated by reference and fully included in the disclosure content of this description.

The web storage 7 is arranged on a schematically shown chassis 13 together with the material web infeed 8, the cross cutting device 9, the shingling device 11 and the braking device 12. The chassis 13 is mounted on rollers 14 and can be displaced transversely to the transport direction 10 of the sheets 3 relative to the web unwinding 4. During an interruption of the material web processing, the chassis 13 can be moved out of the processing line transverse to the transport direction 10 of the sheets 3. In this way, especially during repair and maintenance work, the accessibility to the components and assemblies on chassis 13 and to the adjacent components and assemblies can be improved. Alternatively or additionally, chassis 13 can also be guided on rails not shown. Other components and assemblies, such as the crushing tool 6, can also be arranged on chassis 13 and can be moved laterally together with it.

As FIG. 1 shows, the web storage 7 is horizontally aligned and arranged below the sheet transport level of the sheets 3 in the area between the material web infeed 8 and the braking device 12. The material web 2 can be fed into the web storage 7 in vertical direction. The material web 2 is guided over a first fixed deflection roller 15 as a component of the web storage 7 and, forming a web loop 16, around a first movable deflection roller 17. The following deflection roller along the web transport path is designed as dancer deflection roller 18. To form a second web loop 19, the material web 2 is then guided around a second movable deflection roller 20 to a second fixed deflection roller 21. The material web 2 then leaves the web storage 7 in vertical direction and is deflected by another deflection roller 22, which is outside the system boundary of the web storage 7, to the material web infeed 8.

The two movable deflection rollers 17, 20 can be moved together in horizontal direction by a drive 23. The movable deflection rollers 17, 20 can be moved in the direction of the web unwinding 4 and brought into a threading position 24 (in FIG. 1 shown as dashed lines). In the threading position 24, the horizontal distance of the movable deflection rollers 17, 20 to the web unwinding 4 is smaller than the distance between the fixed deflection rollers 15, 21 and the web unwinding 4. When changing the paper roller 5, the material web 2 can then be easily passed in vertical direction linearly between the fixed deflection rollers 15, 21 and the movable deflection rollers 17, 20. This eliminates the need for time-consuming manual wrapping of the movable deflection rollers 17, 21 to form the web loops 16, 19. After the material web 2 has been fed through the material web infeed 8, the movable deflection rollers 17, 20 can be moved in the transport direction 10 of the sheets 3 to a so-called home position 25, where no web material or only a short length of the material web 2 is stored or held in the web storage 7.

Figure 2:
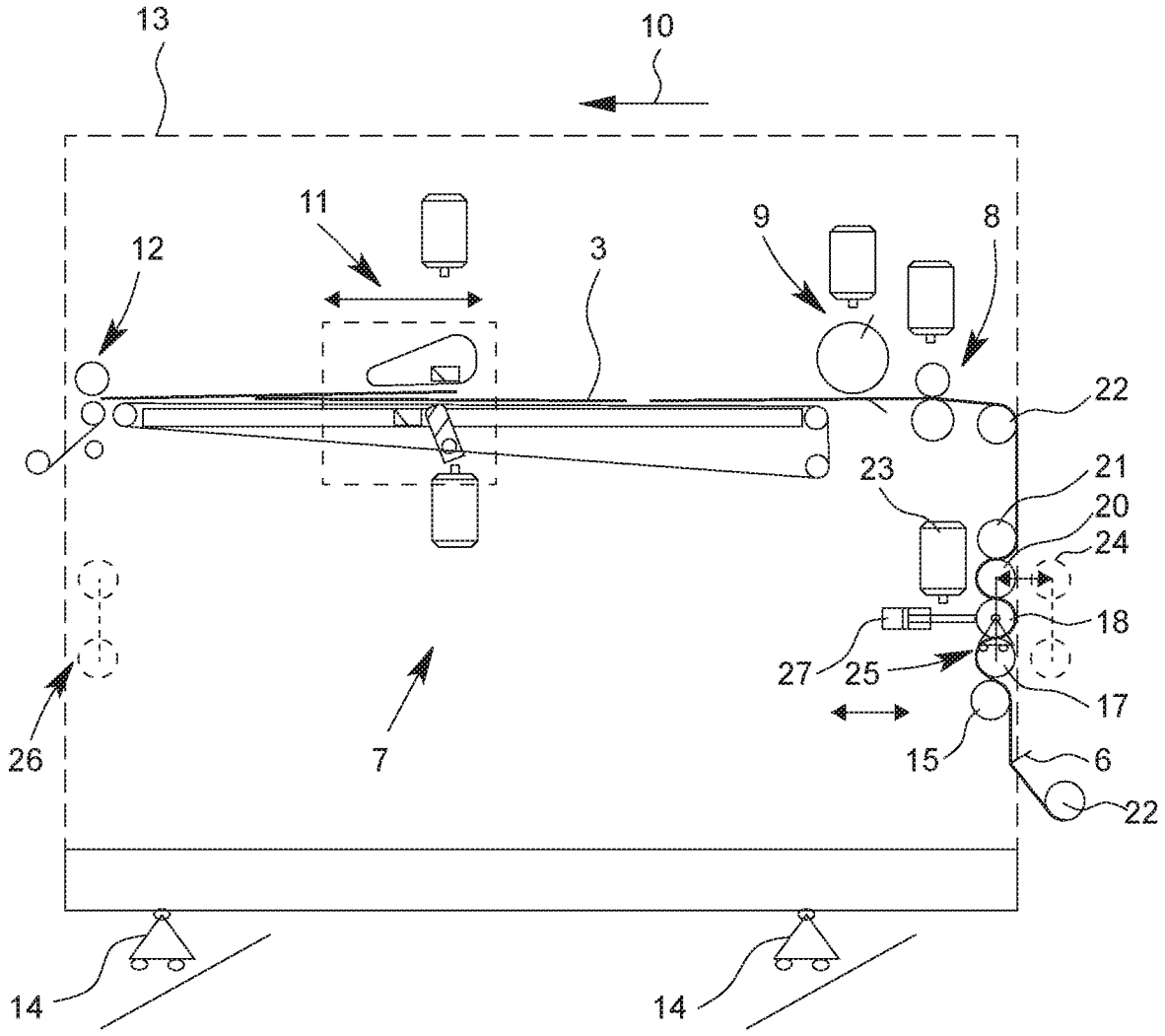

FIG. 2 shows the chassis 13 with the web storage 7, whereby the movable deflection rollers 17, 20 are in the home position 25. As shown in FIG. 2, the basic position 25 can be in vertical and/or horizontal direction in the area between the fixed deflection rollers 15, 21. Alternatively, the basic position 25 can also be located laterally next to the fixed deflection rollers 15, 21 in transport direction 10 of the bends 3.

Figure 3:
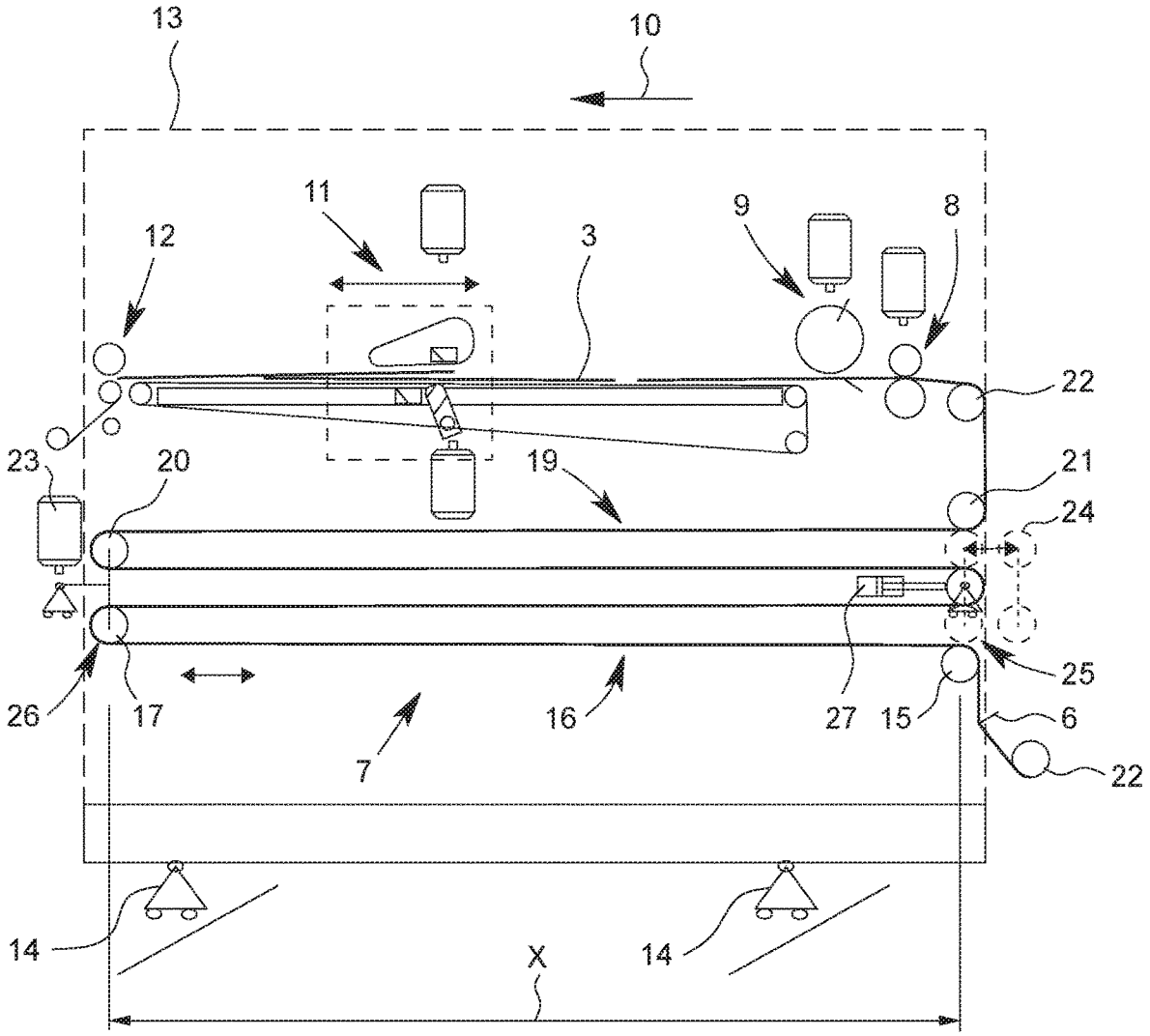

FIG. 3 shows the chassis 13 with the web storage 7, whereby the movable deflection rollers 17, 20 are in a storage position 26. The storage position 26 marks the maximum travel position of the movable deflection rollers 17, 20 in the transport direction 10 of the bends 3. The movable deflection rollers 17, 20 can be moved between the home position 25 and the storage position 26 when operating the apparatus 1. The distance X between the home position 25 and the storage position 26 defines the maximum length of the storage section and thus determines the maximum length of the material web 2 to be taken up by the web storage 7. The length of the maximum length of the material web 2 that can be picked up corresponds essentially to four times the length of the storage section, i.e. essentially four times the distance X from FIG. 3. In the design of the web storage 7 shown in FIG. 3, the distance X corresponds to half the length of a web loop 16, 19. The basic position 25 of the movable deflection rollers 17, 20 can also be further to the left with reference to FIG. 3, i.e. shifted in the direction of the braking device 12.

When braking or stopping the apparatus 1, the material web infeed 8, the cross cutting device 9, the shingling device 11 and the braking device 12 must be stopped synchronously in order to ensure the synchronized running of the above mentioned assemblies. Due to the high mass inertia of the paper roll 5, the web unwinding 4 can only be braked with a time delay to the above-mentioned devices. When braking the apparatus 1, the movable deflection rollers 17, 20 are moved in transport direction 10 of the sheets to take up the material web 2. The length of the storage section and thus also the length of the web loops 16, 19, is increased in this way. The excess material web 2 is thus taken up and stored by the web storage 7. The tension of the material web 2 preferably remains unchanged during the braking process.

When the apparatus 1 is started up again, the material web infeed 8, the cross cutting device 9, the shingling device 11 and the braking device 12 can be started up synchronously and briefly before the web unwinding 4. The web storage 7 then takes over the function of providing the stored material web 2. For this purpose the movable deflection rollers 17, 20 are moved against the transport direction 10 of the sheets. The length of the web loops 16, 19 is reduced in this way and the previously stored material web 2 is released by the storage. As soon as the web unwinding 4 has reached the production speed of the other assemblies, the movable deflection rollers 17, 20 stop and are then preferably in the home position 25. During operation of the apparatus 1, the movable deflection rollers 17, 20 can be moved between the home position 25 and the storage position 26 for storing the material web 2.

Along the web transport path between the first movable deflection roller 17 and the second movable deflection roller 20, a dancer deflection roller 18 is provided for regulating the material web tension. The compensation of web tensions is effected by the dancer deflection roller 18 with a hydraulic drive 27 performing small lifting movements in and/or against the transport direction 10 of the sheets 3 in horizontal direction. In this way the length of the web transport path is slightly increased or reduced. If, for example, the tension of the material web 2 is too low, the dancer deflection roller 18 is moved against the transport direction 10 of the sheets 3, thus increasing the length of the web transport path. This increases the tension in the material web 2. Conversely, if the web tension is increased, the length of the web transport path is reduced by a lifting movement of the dancer guide roller 18 in transport direction 10 of the sheets 3. The control of the web tension is thus directly integrated into the web storage 7. The need to provide a device for controlling the web tension that is spatially separate from the web storage 7 is eliminated.

REFERENCE SIGNS

1 Apparatus
2 Material web
3 Sheets
4 Web unwinding
5 Paper roll
6 Crushing tool
7 Web storage
8 Material web infeed
9 Cross-cutting device
10 Transport direction
11 Shingling device
12 Braking device
13 Chassis
14 Roll
15 Deflection roller
16 Web loop
17 Deflection roller
18 Dancer deflection roller
19 Web loop
20 Deflection roller
21 Deflection roller
22 Deflection roller
23 Drive
24 Threading position
25 Home position
26 Storage position
27 Drive

The invention claimed is:

1. An apparatus for forming a shingled stream of underlapping or overlapping sheets, the apparatus having:

a cross-cutting device for cutting a material web into individual sheets;

a shingling device downstream of the cross-cutting device in a transport direction of the sheets, the shingling device being configured for regionally underlapping or overlapping the sheets;

a braking device downstream of the shingling device in the transport direction of the sheets, the braking device being configured for braking shingled sheets; and a web storage upstream of the cross-cutting device along a web transport path, the web storage being configured for storing and/or providing the material web;

a material web infeed provided upstream of the cross-cutting device along the web transport path;

wherein the material web is fed to the web storage from a web roll arranged horizontally adjacent to the cross-cutting device and the web storage;

wherein the material web infeed is configured to feed the material web from the web storage to the cross-cutting device;

wherein the web storage is configured to store the material web between the material web infeed and the cross-cutting device in a transport direction of the material web;

wherein the web storage is arranged directly vertically beneath the cross-cutting device and below a running height of the sheets and extends beyond the shingling device in the direction of the braking device below the running height of the sheets;

wherein the web storage includes:

a plurality of stationary deflection rollers including at least two stationary deflection rollers lying vertically one above the other;

at least one displaceable deflection roller; and a drive for moving the at least one displaceable deflection roller:

wherein the drive is configured to move the at least one displaceable deflection roller horizontally into a threading position, in which a horizontal distance between the at least one displaceable deflection roller and the web roll is smaller than a horizontal distance between the at least two stationary deflection rollers and the web roll; and wherein the drive is configured to move the at least one displaceable deflection roller horizontally into a maximum storage position, in which a horizontal distance between the at least one displaceable deflection roller and the web roll is greater than a horizontal distance between every stationary deflection roller in the plurality of stationary deflection rollers and the web roll;

wherein the material web infeed, the cross-cutting device, the shingling device and the braking device are configured to stop synchronously in response to stopping of the apparatus;

wherein, in response to stopping of the apparatus, the web roll is configured to brake with a time delay with respect to the material web infeed, the cross-cutting device, the shingling device and the braking device;

wherein the drive is configured to move the at least one displaceable deflection roller in the transport direction of the sheets toward the maximum storage position in response to stopping of the apparatus such that the web storage takes up and stores excess material web from the web roll; and wherein, in response to subsequent start-up of the apparatus, the material web infeed, the cross-cutting device, the shingling device and the braking device are configured to be started synchronously and before the web roll is started, and the drive is configured to move the at least one displaceable deflection roller opposite the transport direction of the sheets, so that the excess material web is released by the web storage to the material web infeed.

2. The apparatus according to claim 1, wherein the braking device is configured to brake the shingled sheets by forming a braking gap for the passage of sheets brought together in an overlapping manner; and wherein the web storage is configured to store the material web between the cross-cutting device and the braking device in the transport direction of the sheets.

3. The apparatus according to claim 1, wherein the at least two stationary deflection rollers are arranged between the cross-cutting device and the web roll.

4. The apparatus according to claim 3, wherein when the at least one displaceable deflection roller is in the threading position, the at least one displaceable deflection roller is located laterally between the at least two stationary deflection rollers and the web roll.

5. The apparatus according to claim 4, wherein when the at least one displaceable deflection roller is in the maximum storage position, the length of a storage section of the material web between the at least two stationary deflection rollers and the at least one displaceable deflection roller is maximum;

wherein the maximum storage position is reached in the region between the cross-cutting device and the braking device.

6. The apparatus according to claim 5, wherein the maximum storage position is reached in the region between the shingling device and the braking device.

7. The apparatus according to claim 4, wherein the at least one displaceable deflection roller comprises two displaceable deflection rollers;

wherein the web storage has at least one horizontally movable dancer deflection roller for influencing the material web tension; and wherein the dancer deflection roller is provided in a transport direction of the material web in the region vertically between the two displaceable deflection rollers of the web storage.

8. The apparatus according to claim 1, wherein the web storage, the cross-cutting device, and the shingling device are mounted on a chassis which is designed to be movable perpendicularly to the transport direction of the sheets relative to the web roll.

9. An apparatus comprising:

a cross-cutting device for cutting a material web into individual sheets;

a web storage upstream of the cross-cutting device along a web transport path, the web storage being configured for storing and/or providing the material web; and a material web infeed upstream of the cross-cutting device along the web transport path, the material web infeed being configured for drivingly feeding the material web from the web storage to the cross-cutting device;

wherein the material web is fed to the web storage from a web roll;

wherein the web storage is configured to store the material web between the material web infeed and the cross-cutting device in a transport direction of the material web;

wherein the web storage is arranged directly vertically below the cross-cutting device and below a running height of the sheets;

wherein the web storage includes:

at least two stationary deflection rollers lying vertically one above the other;

at least one displaceable deflection roller; and a drive for moving the at least one displaceable deflection roller;

wherein the drive is configured to move the at least one displaceable deflection roller horizontally in a first direction toward the web roll into a threading position in which the at least one displaceable deflection roller is located laterally between the at least two stationary deflection rollers and beyond the material web infeed;

wherein when the at least one displaceable deflection roller is in the threading position, a horizontal distance between the at least one displaceable deflection roller and the web roll is smaller than a horizontal distance between the at least two stationary deflection rollers and the web roll; and wherein the drive is configured to move the at least one displaceable deflection roller horizontally in a second direction opposite the first direction into a storage position in which the web storage stores excess material web;

wherein the material web infeed and the cross-cutting device are configured to stop synchronously in response to stopping of the apparatus;

wherein, in response to stopping of the apparatus, the web roll is configured to brake with a time delay with respect to the material web infeed and the cross-cutting device;

wherein the drive is configured to move the at least one displaceable deflection roller in the second direction toward the storage position in response to stopping of the apparatus such that the web storage takes up and stores the excess material web from the web roll; and wherein, in response to subsequent start-up of the apparatus, the material web infeed and the cross-cutting device are configured to be started synchronously and before the web roll is started, and the drive is configured to move the at least one displaceable deflection roller in the first direction, so that the excess material web is released by the web storage to the material web infeed.

10. The apparatus according to claim 9, wherein in the threading position, the at least one displaceable deflection roller is located laterally between the at least two stationary deflection rollers and the web roll, beyond the material web infeed in the direction of the web roll.

11. An apparatus for forming a shingled stream of underlapping or overlapping sheets, the apparatus having:

a cross-cutting device for cutting a material web into individual sheets;

a shingling device downstream of the cross-cutting device in a transport direction of the sheets, the shingling device being configured for regionally underlapping or overlapping the sheets;

a braking device downstream of the shingling device in the transport direction of the sheets, the braking device being configured for braking shingled sheets;

a web storage upstream of the cross-cutting device along a web transport path, the web storage being configured for storing and/or providing the material web; and a material web infeed provided upstream of the cross-cutting device along the web transport path;

wherein the material web is fed to the web storage from a web roll;

wherein the material web infeed is configured to feed the material web from the web storage to the cross-cutting device;

wherein the web storage is configured to store the material web between the material web infeed and the cross-cutting device in a transport direction of the material web;

wherein the web storage is arranged directly vertically below the cross-cutting device and below a running height of the sheets;

wherein the web storage includes:

a plurality of stationary deflection rollers including at least two stationary deflection rollers lying vertically one above the other;

at least one displaceable deflection roller; and a drive for moving the at least one displaceable deflection roller:

wherein the drive is configured to move the at least one displaceable deflection roller horizontally in a first direction toward the braking device into a maximum storage position in which the at least one displaceable deflection roller is located vertically below the braking device;

wherein when the at least one displaceable deflection roller is in the maximum storage position, a horizontal distance between the at least one displaceable deflection roller and the web roll is greater than a horizontal distance between every stationary deflection roller in the plurality of stationary deflection rollers and the web roll;

wherein the material web infeed, the cross-cutting device, the shingling device and the braking device are configured to stop synchronously in response to stopping of the apparatus;

wherein, in response to stopping of the apparatus, the web roll is configured to brake with a time delay with respect to the material web infeed, the cross-cutting device, the shingling device and the braking device;

wherein the drive is configured to move the at least one displaceable deflection roller in the first direction toward the maximum storage position in response to stopping of the apparatus such that the web storage takes up and stores excess material web from the web roll; and wherein, in response to subsequent start-up of the apparatus, the material web infeed, the cross-cutting device, the shingling device and the braking device are configured to be started synchronously and before the web roll is started, and the drive is configured to move the at least one displaceable deflection roller is in a second direction opposite the first direction, so that the excess material web is released by the web storage to the material web infeed.

* * * * *